US008212732B2

(12) United States Patent
Petersson et al.

(10) Patent No.: US 8,212,732 B2
(45) Date of Patent: Jul. 3, 2012

(54) DUAL POLARIZED ANTENNA WITH NULL-FILL

(75) Inventors: Sven Petersson, Sävedalen (SE); Anders Derneryd, Göteborg (SE); Ulrika Engström, Floda (SE); Martin Johansson, Mölndal (SE); Lars Manholm, Göteborg (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 455 days.

(21) Appl. No.: 12/598,817

(22) PCT Filed: May 4, 2007

(86) PCT No.: PCT/SE2007/050302

§ 371 (c)(1), (2), (4) Date: Nov. 4, 2009

(87) PCT Pub. No.: WO2008/136715

PCT Pub. Date: Nov. 13, 2008

(65) Prior Publication Data

US 2010/0149068 A1 Jun. 17, 2010

(51) Int. Cl.
*H01Q 13/10* (2006.01)

(52) U.S. Cl. ..... 343/770; 343/797; 343/700 MS

(58) Field of Classification Search ..... 343/700 MS, 343/770, 797, 893

See application file for complete search history.

(56) References Cited

U.S. PATENT DOCUMENTS

| | | | | |
|---|---|---|---|---|
| 6,018,320 | A * | 1/2000 | Jidhage et al. | 343/700 MS |
| 7,652,623 | B2 * | 1/2010 | Oomuro | 342/360 |
| 2009/0289864 | A1 * | 11/2009 | Derneryd et al. | 343/758 |

* cited by examiner

*Primary Examiner* — Hoanganh Le
(74) *Attorney, Agent, or Firm* — Roger S. Burleigh

(57) ABSTRACT

The present invention relates to a dual polarized array antenna comprising at least two dual polarized antenna elements being arranged for radiating electromagnetic energy having a first polarization, constituting a first antenna radiation pattern, via a connection to a first antenna port, and electromagnetic energy having a second polarization, constituting a second antenna radiation pattern, via a connection to a second antenna port, the second polarization being orthogonal to the first polarization, the first antenna radiation pattern and second antenna radiation pattern each having a main beam and a number of side-lobes with nulls. The array antenna comprises at least one further dual polarized antenna element arranged for radiating electromagnetic energy having two mutually orthogonal polarizations, constituting further antenna radiation patterns, via respective connections to the first antenna port and the second antenna port, where the polarization of said at least one further dual polarized antenna element that is associated with the first antenna port deviates from the first polarization such that said at least one null of the first antenna pattern is at least partly filled.

9 Claims, 4 Drawing Sheets

DUAL POLARIZED ANTENNA WITH NULL-FILL

TECHNICAL FIELD

The present invention relates to a dual polarized array antenna comprising at least two dual polarized antenna elements being arranged for radiating electromagnetic energy having a first polarization, constituting a first antenna radiation pattern, via a connection to a first antenna port, and electromagnetic energy having a second polarization, constituting a second antenna radiation pattern, via a connection to a second antenna port, the second polarization being orthogonal to the first polarization, the first antenna radiation pattern and second antenna radiation pattern each having a main beam and a number of side-lobes with nulls positioned at angular positions between a side-lobe and an adjacent side-lobe or the main beam when adjacent.

BACKGROUND

For mobile communication transmissions of today, such as MIMO, it is often desirable to use dual polarized antennas. Generally, a dual polarized antenna comprises a first number of first antenna elements, having a first polarization, and a second number of second antenna elements having a second polarization. Normally, the first and second numbers are equal, and the first polarization and second polarization are mutually orthogonal, constituting a number of dual polarized antenna elements. The first antenna elements are connected to a first antenna beam port, and the second antenna elements are connected to a second antenna beam port. Depending on the number of antenna elements, corresponding distribution networks are used.

Often the first and the second polarizations are provided with dual orthogonal polarized antenna elements, where the first polarization is associated with the first antenna beam port and the second polarization is associated with the second antenna beam port.

The antenna radiation patterns of the antenna elements of each polarization may be tilted electrically by feeding each antenna element with a certain phase. Such an electrical tilt requires that at least two antenna elements are used for each polarization. The electrical tilt may be fixed or adjustable, and set by means of how the distribution network is designed. In some cases also a certain amplitude is applied to each antenna element for side-lobe control.

For each polarization of a dual polarized sector covering antenna having a number of antenna elements in a vertical column, there is normally a broad coverage in azimuth, perpendicular to the longitudinal extension of the antenna column, in a broad main antenna beam. In elevation, along the longitudinal extension of the antenna column, there is normally a relatively narrow coverage in a narrow antenna beam with adjacent side-lobes. In so-called null directions in elevation there is a very low antenna gain, between the side-lobes. In these directions, so-called nulls are present in the antenna radiation pattern. These nulls are present for both polarizations. Consequently, the path-gain is quite low in these null directions.

It is desirable to increase the path-gain in the null directions, with maintained orthogonality between the two radiation patterns comprised in the array antenna.

In WO 2006/065172 single polarized sub-array antennas, each sub-array antenna comprising a number of antenna elements having a certain polarization, are mounted in such a way that they constitute a total array antenna. It is suggested that a sub-array having a different polarization is mixed with the others in order to provide null-fill.

The document WO 2006/065172 only concerns a single polarized antenna, and the proposed solution for null-fill requires one additional sub-array.

There is thus a need for a dual polarized antenna with increased path-gain in the null directions, with maintained orthogonality between the polarizations.

SUMMARY

The object of the present invention is to provide a dual polarized antenna with mutually orthogonal polarizations which is arranged for increased path-gain in the null directions, with maintained orthogonality between the polarizations.

Said object is achieved by means of a dual polarized array antenna as mentioned initially. The array antenna furthermore comprises at least one further dual polarized antenna element, being arranged for radiating electromagnetic energy having two mutually orthogonal polarizations, constituting further antenna radiation patterns, via respective connections to the first antenna port and the second antenna port, where the polarization of said at least one further dual polarized antenna element that is associated with the first antenna port deviates from the first polarization and at least one null of the first antenna radiation pattern has a different angular position than any null of that further antenna radiation pattern that is radiated via the first antenna port, such that said at least one null of the first antenna pattern is at least partly filled.

In a preferred embodiment, the array antenna comprises at least two further dual polarized antenna elements, where those polarizations of said further dual polarized antenna elements that are associated with the first antenna port have differently rotated orientations.

In another preferred embodiment, a polarization of said at least one further dual polarized antenna element which is associated with the first antenna port, is orthogonal to the first polarization.

In another preferred embodiment, those polarizations which are associated with the first antenna port are associated with said first antenna port via a first distribution network, and that those polarizations which are associated with the second antenna port are associated with said second antenna port via a second distribution network.

In another preferred embodiment, the distribution networks are arranged in such a way that they provide a certain phase taper and/or amplitude taper to the dual polarized antenna elements.

In another preferred embodiment, said dual polarized antenna elements are arranged in a column.

Further preferred embodiments are apparent from the dependent claims.

A number of advantages are obtained from the present invention. For example:

- Nulls in the radiation patterns are filled for a dual polarized antenna.
- Path-gain in the null directions, in the side-lobe region of the radiation pattern, is increased.
- Orthogonality between the radiation patterns is maintained.
- The number of degrees of freedom for radiation pattern synthesis is increased.

BRIEF DESCRIPTION OF THE DRAWING

The present invention will now be described more in detail with reference to the appended drawing, where FIG. 1 schematically shows a front view of an array antenna according to the present invention.

DETAILED DESCRIPTION

Figure 1:
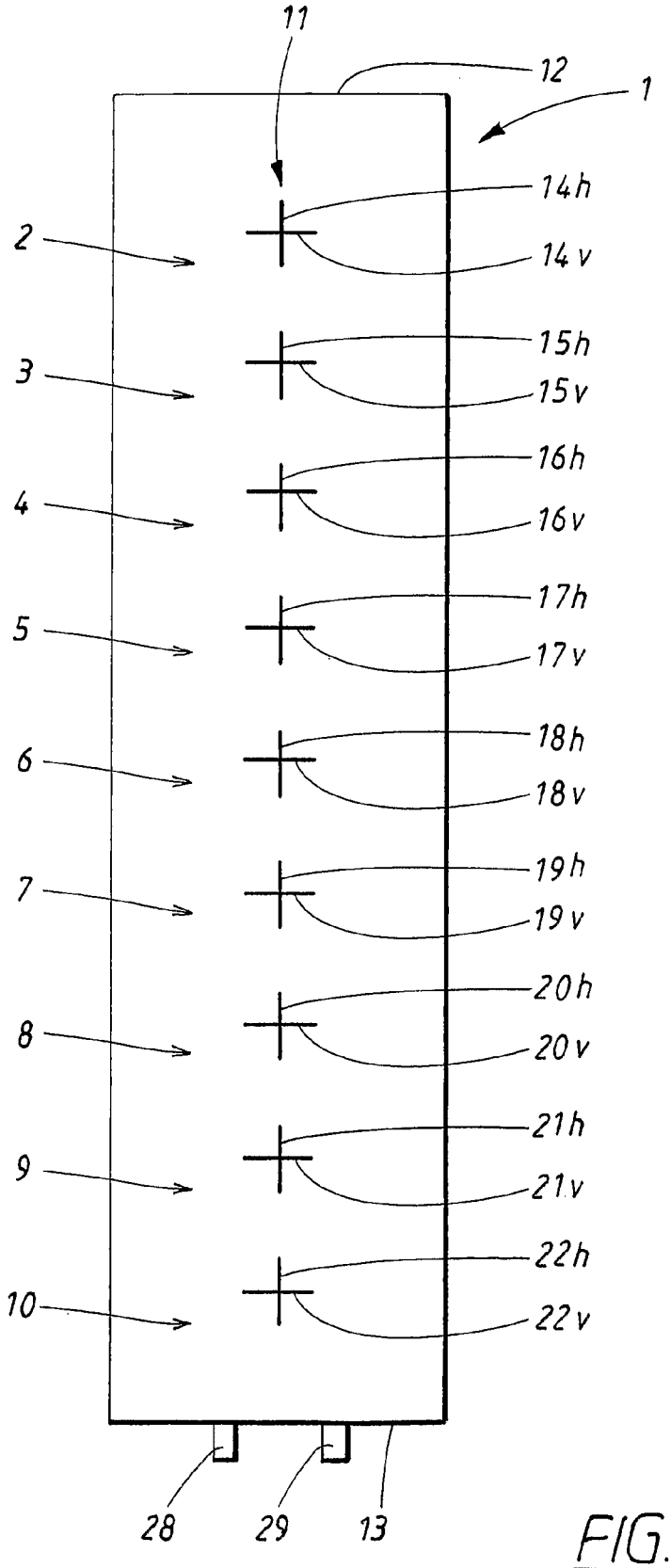

In FIG. 1 is shown a front view of a dual orthogonal polarized array antenna comprising nine dual polarized antenna elements 2, 3, 4, 5, 6, 7, 8, 9, 10, placed in a column 11. Each antenna element 2, 3, 4, 5, 6, 7, 8, 9, 10 is arranged for radiating electromagnetic energy having a first, vertical, polarization and a second, horizontal, polarization. The column 11 extends in a longitudinal extension of the array antenna 1, the array antenna 1 having a first end 12 a second end 13. Each antenna element 2, 3, 4, 5, 6, 7, 8, 9, 10 is shown in the form of two crossed orthogonal slots, where each vertically oriented slot 14*h*, 15*h*, 16*h*, 17*h*, 18*h*, 19*h*, 20*h*, 21*h*, 22*h*, i.e. oriented along the longitudinal extension of the array antenna 1, relates to the horizontal polarization, and each horizontally oriented slot 14*v*, 15*v*, 16*v*, 17*v*, 18*v*, 19*v*, 20*v*, 21*v*, 22*v*, i.e. oriented perpendicular to the longitudinal extension of the array antenna 1, relates to the vertical polarization. The slots 14*h*, 15*h*, 16*h*, 17*h*, 18*h*, 19*h*, 20*h*, 21*h*, 22*h*; 14*v*, 15*v*, 16*v*, 17*v*, 18*v*, 19*v*, 20*v*, 21*v*, 22*v* are crossed and thus pair-wise co-located, each pair having the same phase-centre and constituting one of said dual polarized antenna elements 2, 3, 4, 5, 6, 7, 8, 9, 10.

Figure 2:
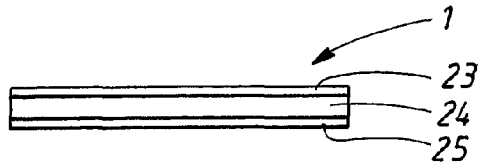
FIG. 2 schematically shows a side view of an array antenna according to the present invention.

With reference also to FIG. 2, showing a side view of the short end of the array antenna, the slots 14*h*, 15*h*, 16*h*, 17*h*, 18*h*, 19*h*, 20*h*, 21*h*, 22*h*; 14*v*, 15*v*, 16*v*, 17*v*, 18*v*, 19*v*, 20*v*, 21*v*, 22*v* are etched from a copper layer 23 on one side of a dielectric carrier 24, for example constituted by glass-fibre reinforced PTFE. Each slot 14*h*, 15*h*, 16*h*, 17*h*, 18*h*, 19*h*, 20*h*, 21*h*, 22*h*; 14*v*, 15*v*, 16*v*, 17*v*, 18*v*, 19*v*, 20*v*, 21*v*, 22*v* is fed by a microstrip distribution network (not shown, being of a well known kind) etched from a copper layer 25 on the other side of the dielectric carrier 24.

Figure 3:
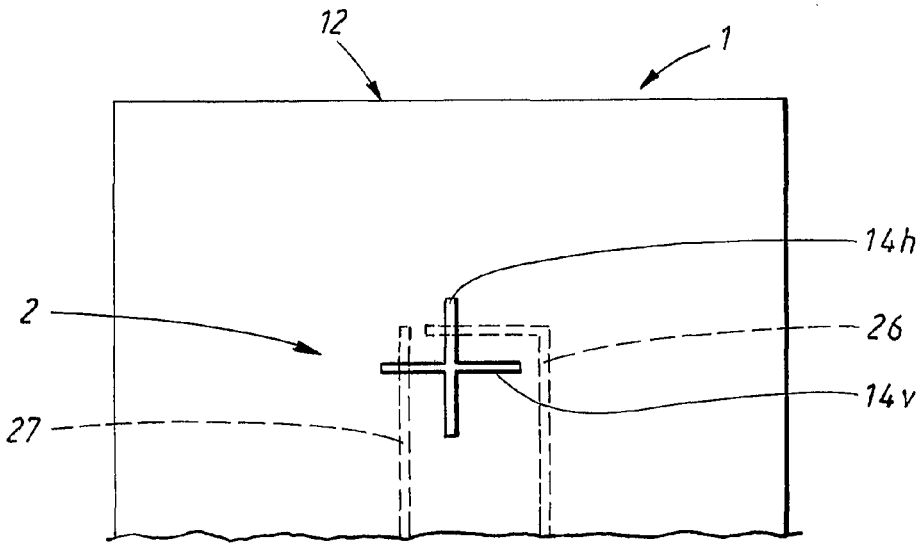
FIG. 3 schematically shows an enlarged view of an antenna element and its feed.

As shown in detail in FIG. 3, showing an enlarged front view of the slots 14*v*, 14*h* in the first antenna element 2, a first microstrip conductor 26, being a part of a first distribution network, passes perpendicular to the main extension of the horizontally polarized slot 14*h* on said other side of the dielectric carrier 24 and ends after a certain distance. Furthermore, a second microstrip conductor 27, being a part of a second distribution network, passes perpendicular to the main extension of the vertically polarized slot 14*v* on said other side of the dielectric carrier 24 and ends after a certain distance. This type of slot feed is previously known in the art. The microstrip conductors 26, 27 cross the respective slot 14*v*, 14*h* offset from their centres, due to their crossed configuration.

An example of a slot feed comprising a fork-shaped slot feed is shown in the prior art document U.S. Pat. No. 6,018,320.

As previously known, patches in the form of metal squares (not shown) may be placed a certain distance above the slots in order to increase the bandwidth, resulting in aperture-fed patch elements.

The distances between the nine antenna elements 2, 3, 4, 5, 6, 7, 8, 9, 10 are equal and chosen in such a way that grating lobes do not appear.

The horizontally polarized slots 14*h*, 15*h*, 16*h*, 17*h*, 18*h*, 19*h*, 20*h*, 21*h* of the first eight antenna elements 2, 3, 4, 5, 6, 7, 8, 9 from the first end 12 are fed by a first distribution network, which is designed in such a way that the slots 14*h*, 15*h*, 16*h*, 17*h*, 18*h*, 19*h*, 20*h*, 21*h* are fed with the same phase and with the same amplitude.

According to the present invention, the vertically polarized slot 22*v* of the ninth antenna element 10 from the first end 12, placed adjacent to the second end 13, is also fed by the first distribution network.

The first distribution network divides or sums power from and to a first antenna port 28, depending on if the first antenna port 28 is transmitting or receiving. For simplicity, in the following, it is assumed that the array antenna 1 is transmitting. Thus, a signal that is applied to the first antenna port 28 is distributed to the horizontally polarized slots 14*h*, 15*h*, 16*h*, 17*h*, 18*h*, 19*h*, 20*h*, 21*h* of said first eight antenna elements 2, 3, 4, 5, 6, 7, 8, 9 and the vertically polarized slot 22*v* of the ninth antenna element 10, where all slots 14*h*, 15*h*, 16*h*, 17*h*, 18*h*, 19*h*, 20*h*, 21*h*, 22*v*, are fed in the same phase and with the same amplitude.

Figure 4:
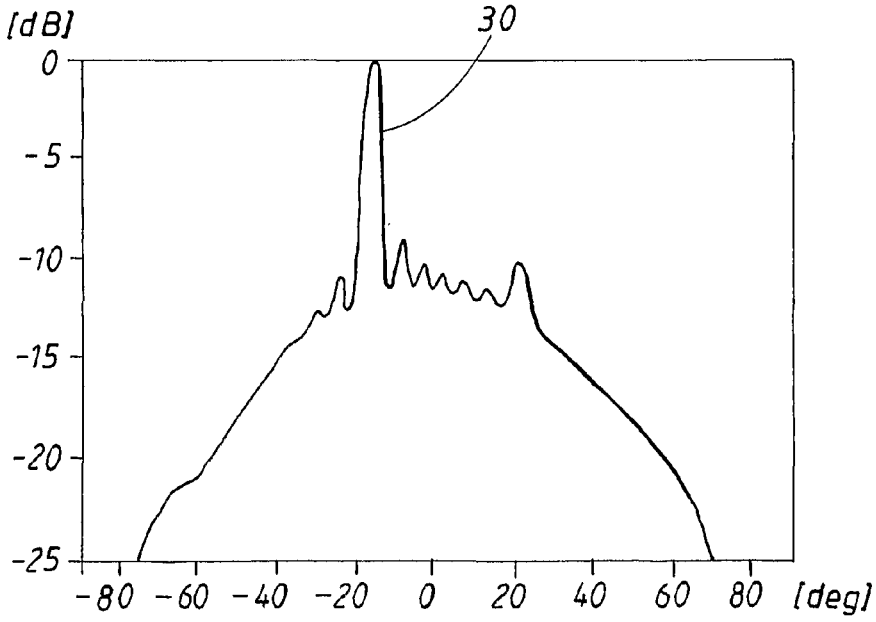
FIG. 4 shows an antenna radiation pattern in elevation for total power.

The antenna radiation pattern in elevation radiated by the first eight slots 14*h*, 15*h*, 16*h*, 17*h*, 18*h*, 19*h*, 20*h*, 21*h*, along the height of the column 11, has nulls in angular directions between a main beam and all side-lobes. The antenna radiation pattern radiated by the ninth slot 22*v*, in the same elevation cut as the first eight slots 14*h*, 15*h*, 16*h*, 17*h*, 18*h*, 19*h*, 20*h*, 21*h*, does not have nulls in the same angular directions as the antenna radiation pattern radiated by the first eight slots 14*h*, 15*h*, 16*h*, 17*h*, 18*h*, 19*h*, 20*h*, 21*h*. Thus the differently polarized ninth slot 22*v* performs null-filling of the power radiation pattern radiated by the first eight slots 14*h*, 15*h*, 16*h*, 17*h*, 18*h*, 19*h*, 20*h*, 21*h*, as shown in FIG. 4, which discloses an antenna radiation pattern 30, in elevation for total power. Here, the total power means the sum of the partial powers in any two orthogonal polarizations.

On the x-axis, the elevation angle in degrees is shown, and on the y-axis, the normalized gain in dB is shown. The resulting polarization of the signal at the first antenna port 28 is not completely horizontal, but rotated due to the ninth vertically polarized slot 22*v*. In this way, null-filling is performed for the signal at the first antenna port 28.

In the same way as described above, the remaining nine slots 14*v*, 15*v*, 16*v*, 17*v*, 18*v*, 19*v*, 20*v*, 21*v*, 22*h* are connected to a second distribution network, which is connected to a second antenna port 29. Thus, a signal that is applied to the second antenna port 29 is distributed to the vertically polarized slots 14*v*, 15*v*, 16*v*, 17*v*, 18*v*, 19*v*, 20*v*, 21*v* of the first eight antenna elements 2, 3, 4, 5, 6, 7, 8, 9 and the horizontally polarized slot 22*h* of the ninth antenna element 10, where all slots 14*v*, 15*v*, 16*v*, 17*v*, 18*v*, 19*v*, 20*v*, 21*v*, 22*h* are fed with the same phase and with the same amplitude when the ninth dual polarized antenna element is rotated 90°. In this way, null-filling is performed for the signal at the second antenna port 29 in the same way as described for the first antenna port 28. The resulting polarization of the signal at the second antenna port 29 is not completely vertical, but rotated due to the ninth horizontally polarized slot 22*h*.

In this manner, the polarization orthogonality is maintained between the radiation patterns of the first antenna port 28 and the second antenna port 29, since the ninth antenna element 10 rotates the respective polarization to the same extent, and similar amplitude and phase characteristics are applied to the antenna elements by the first and second distribution networks.

The ninth antenna element 10 in the example described above thus constitutes a null-filling antenna element, filling the nulls by having a polarization orientation different from the rest of the antenna elements 2, 3, 4, 5, 6, 7, 8, 9 of the array antenna 1.

It is necessary to feed the ninth respective slots 22*v*, 22*h* with an adapted phase and/or amplitude in order to obtain a desired null-fill, but it is important that the same relative phase and amplitude is applied for both slots 22*v*, 22*h* of the ninth antenna element 10, when it is rotated 90°, in order to maintain orthogonality.

The embodiment example described above with reference to FIG. 1 describes the principle of the present invention. More generally, the number of elements in an array antenna according to the present invention may vary. There may be more than one null-filling antenna element in the array antenna, and it/they may have any suitable position along the column of antenna elements in the array antenna.

Figure 5:
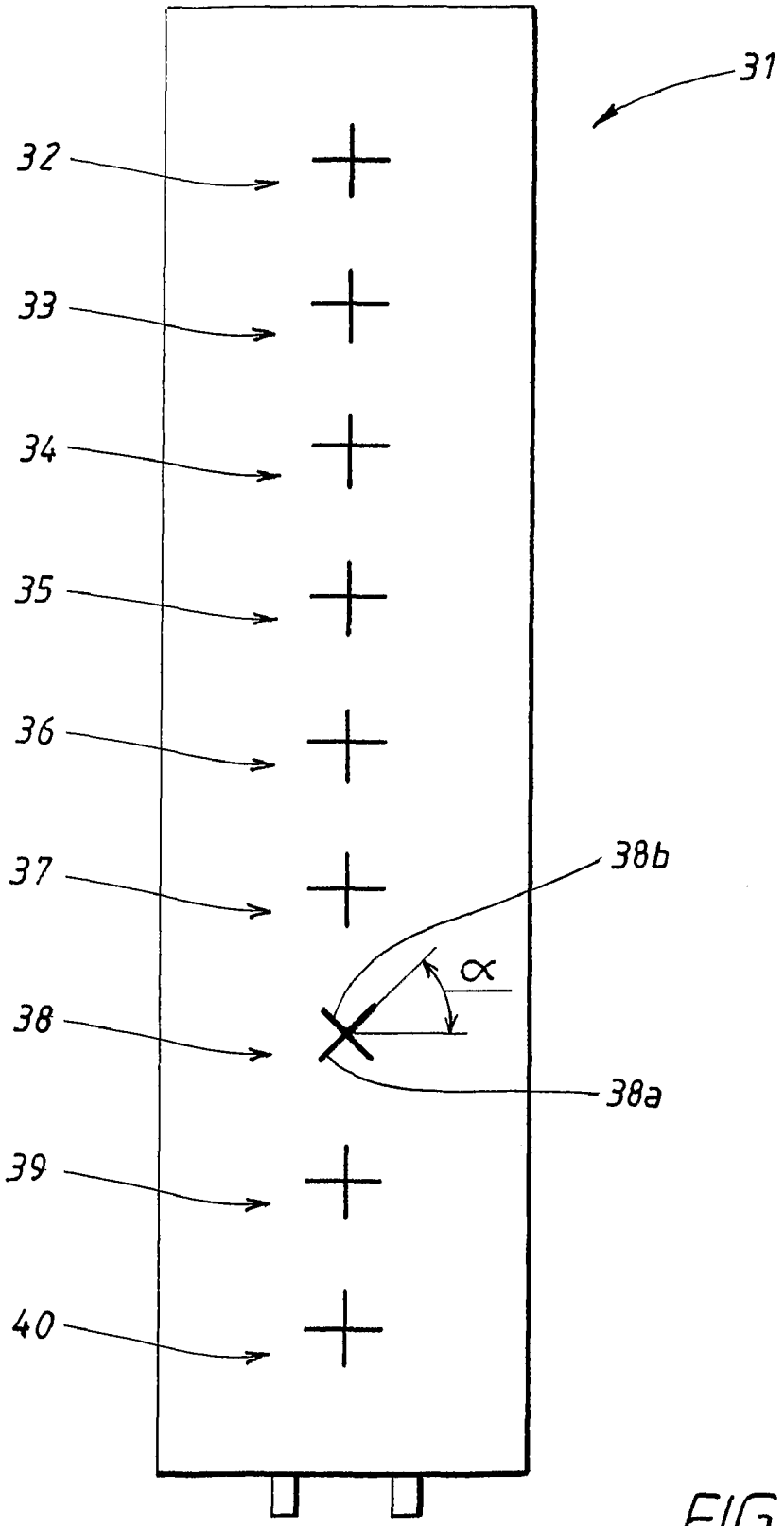
FIG. 5 schematically shows a front view of an alternative array antenna according to the present invention.

The polarizations of a null-filling dual polarized antenna element 10 do not have to be orthogonal to the polarization of the respective other antenna elements 2, 3, 4, 5, 6, 7, 8, 9. In FIG. 5, a front view of an alternative array antenna 31 according to the present invention is shown. This array antenna is similar to the one described with reference to FIG. 1, using the same type of antenna elements. Here, the array antenna comprises nine dual polarized antenna elements 32, 33, 34, 35, 36, 37, 38, 39, 40, similar to the ones shown in FIG. 1.

Here, however, the seventh dual polarized antenna element 38 is rotated an angle a with respect to the other dual polarized antenna elements 32, 33, 34, 35, 36, 37, 39, 40. This means that the seventh dual polarized antenna element 38, constituting a null-filling antenna element, comprises two orthogonal slots 38*a*, 38*b*, which are rotated an angle a with respect to the slots of the other dual polarized antenna elements.

The difference between FIG. 1 and FIG. 5 is thus that the null-filling antenna elements 10, 38 have different positions in the array antenna, and that the null-filling antenna element 38 of FIG. 5 is rotated a certain arbitrary angle a, while the null-filling antenna element 10 of FIG. 1 is rotated 90°. FIG. 5 thus illustrates one of the many embodiments available for the present invention.

Generally, a resulting polarization component of the null-filling antenna element 10, 38 that is orthogonal to the co-polarized component of the other antenna elements 32, 33, 34, 35, 36, 37, 39, 40, contributes to filling at least one null in the radiation pattern related to the co-polarized component of the other antenna elements 32, 33, 34, 35, 36, 37, 39, 40, when said resulting polarization component of the null-filling antenna element 10, 38 interferes with the co-polarized component of the other antenna elements 32, 33, 34, 35, 36, 37, 39, 40.

Furthermore, it should be understood that a horizontal polarization or vertical polarization is not exact due to manufacturing errors and environmental factors. In the context of the present invention, all polarizations are mentioned as they are intended to be in the ideal case, although their exact appearance may be inexact. In the present invention, null-filling antenna elements are intended to have polarizations associated with respective antenna ports that differ from the polarizations of the other antenna elements connected to said respective antenna ports.

The main concept of the present invention is to provide two superimposed antenna radiation patterns for each antenna port 28, 29, where some or all nulls of these antenna radiation patterns do not coincide.

The invention is not limited to the embodiment example above, but may vary freely within the scope of the appended claims.

For example, the dual orthogonal polarized antenna elements 2, 3, 4, 5, 6, 7, 8, 9, 10 may be comprised of any suitable type of radiating structures which can generate linear, circular or elliptical polarization, for example patches, dipoles or a combination thereof.

Furthermore, an ordinary amplitude and/or phase taper may be used in order to, for example, obtain desired side-lobe levels in combination with the present invention. A linear phase taper may be used to obtain a desired beam tilt. Phase shifts may be implemented by means of time delays. Of course, these techniques may be combined.

The distance between the antenna elements 2, 3, 4, 5, 6, 7, 8, 9, 10 may also be chosen such that grating lobes do appear, the array antenna thus constituting a so-called sparse array antenna.

The antenna elements 2, 3, 4, 5, 6, 7, 8, 9, 10 may be non-uniformly spaced.

The distribution networks used may be in any other suitable form than the microstrip distribution network described. Coaxial cables and discrete power divider elements may for example be used. Preferably, the distribution networks connected to the antenna ports 28, 29 have the same mutual phase and amplitude characteristics.

The antenna column 11 shown has been vertically oriented, but any orientation of such an antenna column is conceivable.

Figure 6:
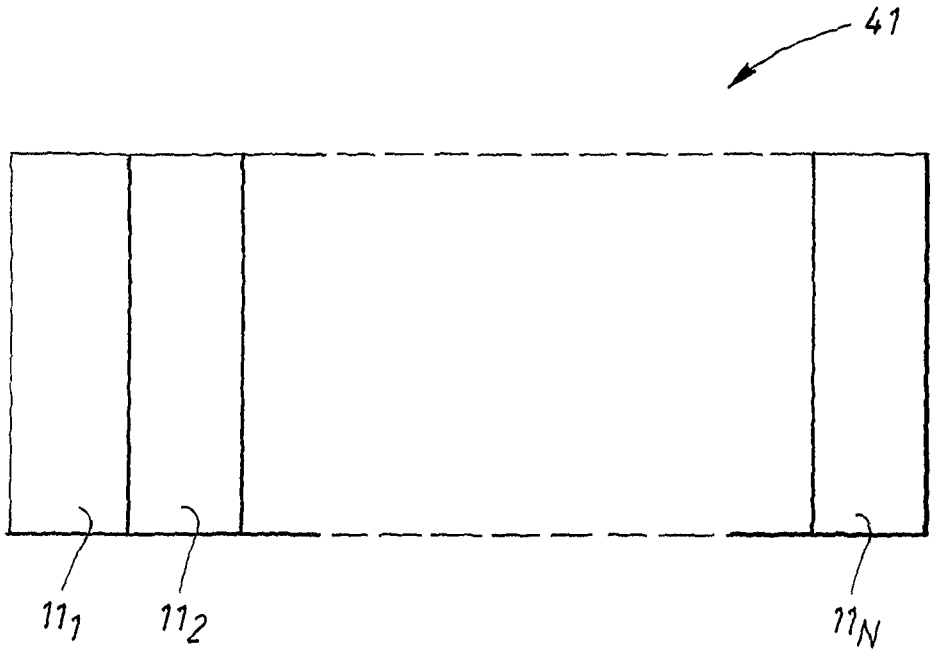
FIG. 6 shows a two-dimensional array antenna.

With reference to FIG. 6, showing a front view of a two-dimensional array antenna 41, two or more antenna columns $\mathbf{11}_1, \mathbf{11}_2 \ldots \mathbf{11}_N$ are arranged between each other, side by side, such that the two-dimensional array antenna 41 is formed. The number of antenna columns $\mathbf{11}_1, \mathbf{11}_2 \ldots \mathbf{11}_N$ is chosen in such a way that a desired two-dimensional array antenna 41 is obtained.

Figure 7:
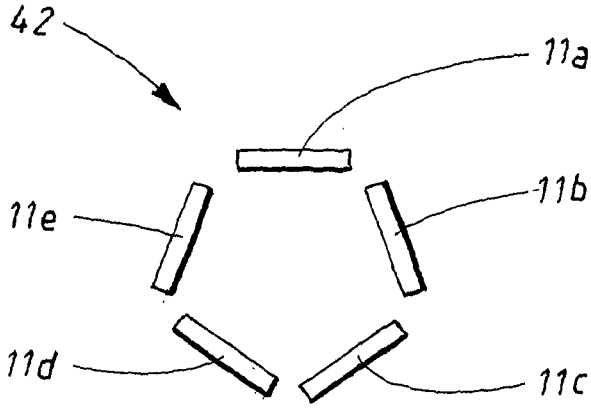
FIG. 7 shows a circularly arranged array antenna.

With reference to FIG. 7, showing a top view of a circular array antenna 42, five antenna columns 11*a*, 11*b*, 11*c*, 11*d*, 11*e* are arranged circularly. The number of circularly arranged antenna columns may vary in such a way that a desired circular array antenna 42, is obtained.

If there is more than one null-filling antenna element in an array antenna, their polarizations may differ. In other words, the null-filling elements' polarizations may be mutually rotated for some or all null-filling elements used.

The invention claimed is:

1. A dual polarized array antenna, comprising:

at least two dual polarized antenna elements being arranged for radiating electromagnetic energy having a first polarization, constituting a first antenna radiation pattern, via a connection to a first antenna port, and electromagnetic energy having a second polarization, constituting a second antenna radiation pattern, via a connection to a second antenna port, the second polarization being orthogonal to the first polarization, the first antenna radiation pattern and second antenna radiation pattern each having a main beam and a number of side-lobes with nulls positioned at angular positions between a side-lobe and an adjacent side-lobe or the main beam when adjacent; and at least one further dual polarized antenna element being arranged for radiating electromagnetic energy having two mutually orthogonal polarizations, constituting further antenna radiation patterns, via respective connections to the first antenna port and the second antenna port, where the polarization of said at least one further dual polarized antenna element that is associated with the first antenna port deviates from the first polarization and at least one null of the first antenna radiation pattern has a different angular position than any null of that further antenna radiation pattern that is radiated via the first antenna port, such that said at least one null of the first antenna pattern is at least partly filled.

2. The dual polarized array antenna according to claim 1, wherein the array antenna comprises at least two further dual polarized antenna elements, where those polarizations of said further dual polarized antenna elements that are associated with the first antenna port have differently rotated orientations.

3. The dual polarized array antenna according to claim 1, wherein a polarization of said at least one further dual polarized antenna element which is associated with the first antenna port is orthogonal to the first polarization.

4. The dual polarized array antenna according to claim 1, wherein those polarizations which are associated with the first antenna port are associated with said first antenna port via a first distribution network, and that those polarizations which are associated with the second antenna port are associated with said second antenna port via a second distribution network.

5. The dual polarized array antenna according to claim 4, wherein the distribution networks are arranged in such a way that they provide a certain phase taper and/or amplitude taper to the dual polarized antenna elements.

6. The dual polarized array antenna according to claim 1 wherein said dual polarized antenna elements are arranged in a column.

7. The dual polarized array antenna according to claim 1, wherein the distribution networks connected to the antenna ports have the same mutual phase and amplitude characteristics.

8. The dual polarized array antenna according to claim 7, wherein at least two columns are arranged side by side, forming a two-dimensional array antenna.

9. The dual polarized array antenna according to claim 7, wherein a plurality of columns are arranged circularly, forming a circular array antenna.

* * * * *